United States Patent [19]

Akkala et al.

[11] 4,280,313

[45] Jul. 28, 1981

[54] PACKAGING APPARATUS

[75] Inventors: Walter I. Akkala; Thomas M. Gorshe, both of Neenah, Wis.

[73] Assignee: American Can Company, Greenwich, Conn.

[21] Appl. No.: 81,528

[22] Filed: Oct. 3, 1979

[51] Int. Cl.[3] ..... B65B 43/30; B31B 11/00

[52] U.S. Cl. ..... 53/175; 53/386; 493/186

[58] Field of Search ..... 53/175, 386; 93/36.01; 493/186

[56] References Cited

U.S. PATENT DOCUMENTS

| | | | |
|---|---|---|---|
| 3,965,652 | 6/1976 | Cimins | 53/386 X |
| 4,150,519 | 4/1979 | Akkala | 53/386 X |

*Primary Examiner*—W. D. Bray

*Attorney, Agent, or Firm*—Robert P. Auber; Ernestine C. Bartlett

[57] ABSTRACT

In plastic pouch forming, improved vacuum boxes that are movable toward and away from one another are provided. Each vacuum box comprises a series of superimposed, paired, mutually spaced vacuum ports in fluid communication with one another, the outer pair of ports being resilient and adapted to frictionally engage a wall portion of a flattened pouch and to flex open upon application of a vacuum to draw portions of the pouch wall into a cavity defined by an underlying port. In the specific and preferred embodiments of the invention, the vacuum boxes comprise (a) a vacuum chamber defined by a hollow metal box body and a cover plate comprising a pair of vacuum ports; (b) a resilient rubber pad affixed to the box cover plate comprising a pair of vertical, elongated vacuum ports, preferably in the form of slots and aligned with overlying the vacuum ports of the cover; and (c) a thin, high friction resilient facing affixed to the rubber pad comprising a pair of vertical, elongated vacuum ports, preferably in the form of slits, and overlying the vacuum slots, preferably in offset lateral relation thereto. A flattened, pouch is placed between the vacuum boxes and a vacuum is introduced to force the confronting flat surfaces of the pouch into frictional engagement with the facing material and to flex the slits formed therein thereby drawing portions of the pouch walls into the slits and partially into the cavity formed by the vacuum slots.

10 Claims, 7 Drawing Figures

FIG. 1
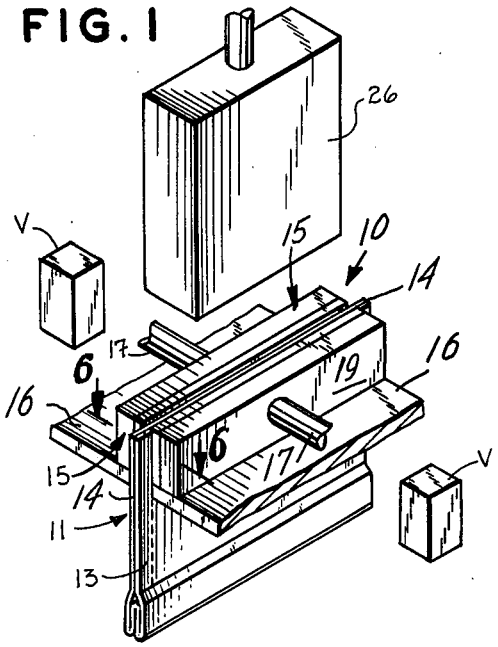
FIG. 2
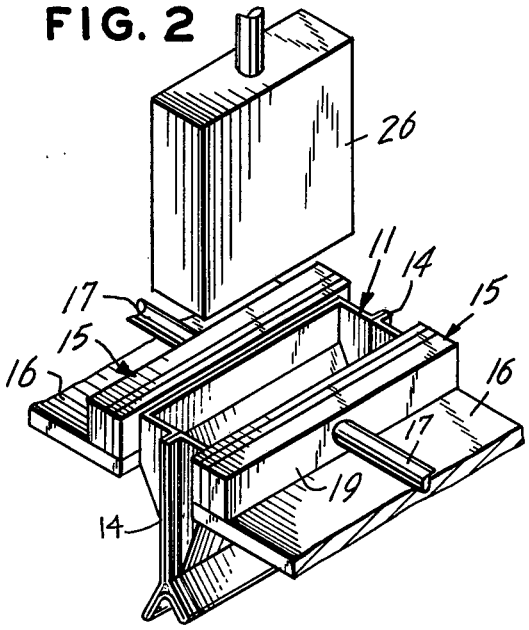
FIG. 3
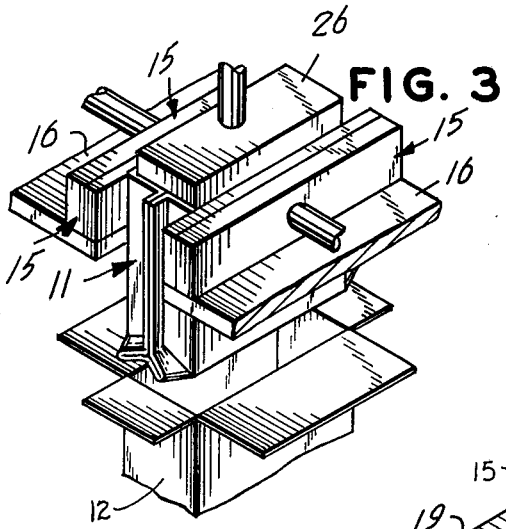
FIG. 4
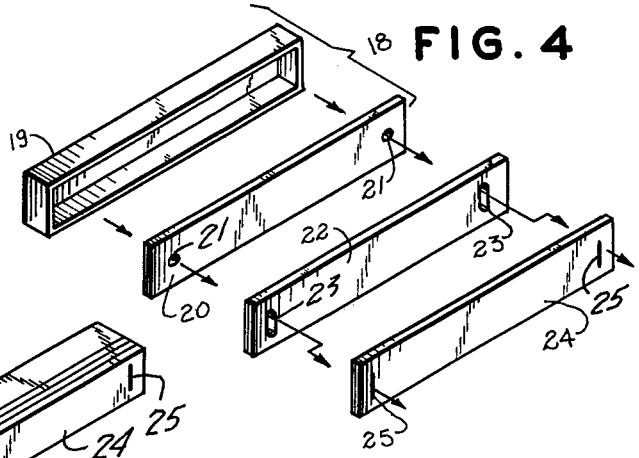
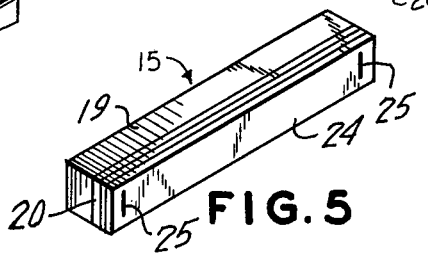
FIG. 5
FIG. 6
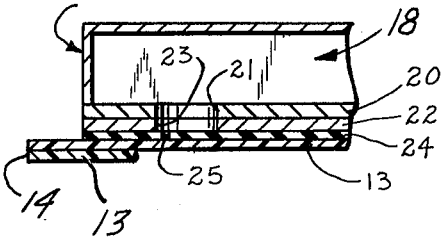
FIG. 7
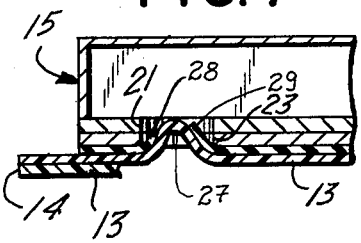

PACKAGING APPARATUS

BACKGROUND OF THE INVENTION

This invention relates to packaging apparatus, and more particularly to apparatus useful in forming pouches to facilitate insertion of articles therein.

Devices are known in the food packaging art for opening thin plastic and/or plastic-foil bags to enable their filling at a station along a transport path of a carrier for such bags. The bags are generally supplied in the form of stacks of flattened bags which may be simple sacks or substantially rectangular plastic panels formed at their bottoms with gussets or a panel of substantially V-cross section so that the section of the bottom has a W-cross section. One system for opening such bags comprises vacuum means for spreading the lips of the mouth of the bag and a mechanical element which is introduced through the open end to spread apart the walls of the bag to the bottom.

Difficulties are frequently encountered with such a system in that the vacuum is often insufficient to maintain the bag in opened position during insertion of the mechanical member at high speed and under high friction generating conditions causing the pouch to fall away from the ram. This has been a particular problem with pouches constructed from materials having high slip properties such as, for example, paraffin-coated or wax treated cellophane.

The following is a listing of U.S. Patents believed material to the state of the art to which this invention pertains.

No. 2,224,656 discloses opposed suction devices movable toward one another to engage a flattened bag and movable apart to open the bag.

No. 2,281,516 discloses opposed suction boxes A for opening collapsed bags B in preparation for filling.

No. 3,453,799 discloses pouch opening apparatus, including suction cups 54, each provided with a flat edge portion 54*a* for eliminating tendency of the pouch wall to become wrinkled.

No. 4,033,096 discloses opposed pairs of suction cups 6 and 9 operative to engage and spread the walls of flattened pouch 1.

No. 4,150,519 discloses a pair of opposed vacuum boxes that are movable toward and away from one another and comprising vacuum cups having an insert with a recessed face portion whereby a vacuum forces surfaces of a pouch placed between the vacuum boxes onto the vacuum cups and partially into the recessed portion thereof.

It is an object of this invention to provide an improved apparatus of the foregoing type.

It is another object of this invention to provide an improved vacuum apparatus which is particularly adapted to retain thin plastic-foil materials having high slip characteristics to ensure full opening of a pouch through insertion of a mandrel.

These and other objects of the invention will be apparent from the description of the invention which follows.

SUMMARY OF THE INVENTION

In achievement of the above objectives, the invention contemplates in packaging apparatus, means for handling a flattened pouch having opposed planar walls joined along side portions thereof to define an opening for receiving material to be packed, the combination comprising: a pair of opposed vacuum box means mounted for movements toward and away from one another; improved means disposed on each said vacuum box means defining a series of superimposed, paired, mutually spaced vacuum ports of differing configuration and in fluid communication with one another, the outer pair of ports being resilient and adapted to frictionally engage a wall portion of the flattened pouch; means for moving said vacuum box means toward one another into position engaging the walls of a flattened pouch in the region of its opening; means for introducing a vacuum through said vacuum box means to effect flexing of said resilient outer port and to draw portions of said pouch walls through said outer port into a cavity defined by the underlying port to initiate formation of a crease in said pouch walls; means for moving said vacuum box means apart while maintaining said vacuum to urge said pouch walls apart; and means for shaping and moving the shaped pouch to a subsequent station.

The manner in which the foregoing as well as other objectives and advantages of the invention may best be achieved will be more fully understood from a consideration of the following description, taken in light of the accompanying drawing.

BRIEF DESCRIPTION OF THE DRAWING

FIGS. 1, 2 and 3 are perspective drawings of portions of a pouch opening apparatus embodying the invention, and illustrating sequential stages of its operation;

FIG. 4 is an exploded view illustrating the components of a vacuum box of the invention;

FIG. 5 is a perspective view showing the assembled components illustrated in FIG. 4, and shows a perspective of a vacuum box of the invention.

FIG. 6 is a enlarged sectional view taken in the plane of line 6—6 of FIG. 1 looking in the direction of arrows applied thereto, and including a sectional showing of a portion of a pouch before application of the vacuum;

FIG. 7 is an enlarged sectional view showing the portion of the pouch illustrated in FIG. 6 after application of a vacuum.

DESCRIPTION OF THE PREFERRED EMBODIMENT

With reference to FIGS. 1 to 3, there is seen pouch handling apparatus 10 for opening and transforming a pouch 11 from flattened configuration (FIG. 1) into rectangular configuration (FIGS. 2 and 3) for insertion into a carton 12 (FIG. 3), or other suitable means, for subsequent filling and sealing by conventional means.

Pouch 11 is formed from a single rectangular sheet of flexible, plastic having high slip characteristics, such as paraffin coated cellophane material 13, folded onto itself so that it is W-shaped in vertical section and sealed along its edges, as seen at 14, to form an open-top container capable of being opened and transformed into generally rectangular cross section for filling.

Handling apparatus 10 comprises means defining a pair of opposed vacuum box means 15 mounted on brackets 16 for movements toward and away from one another. Each vacuum box 15 is connected to a controlled vacuum source of known type, and shown diagramatically at V, FIG. 1, through tubes 17.

As is best seen in FIG. 4, each vacuum box 15 includes a vacuum chamber 18 comprising a hollow box body 19 and a box cover plate 20 having a pair of mutually spaced vacuum ports 21. A resilient, flexible pad 22, formed of closed cell silicone sponge rubber, neoprene rubber and the like, having a pair of elongated vacuum ports, preferably in the form of slots 23, is affixed to cover plate 20 by suitable means, for example, by a suitable adhesive or the like whereby the vacuum slots 23 are in substantial alignment and in fluid communication with the vacuum ports 21 of the cover plate. A thin resilient, flexible facing material, 24, suitably treated to have high surface friction characteristics and comprising a pair of elongated, vertical ports, preferably in the form of slits 25, is affixed to the flexible pad 22 whereby the vacuum slits 25 overlie and are superimposed over said vacuum slots The slits 25 are suitably dimensioned to be substantially narrower in width than the slots 23 and are preferably slightly offset laterally in relation to the slots 23 and ports 20.

A forming mandrel 26 of rectangular configuration is mounted above vacuum box means 15 and is movable vertically by conventional means not shown, between the retracted position seen in FIGS. 1 and 2 and the partially extended position, seen in FIG. 3, and to a fully extended positioned, not shown but as described hereinbelow.

In operation, a flattened pouch 11 to be opened and filled is moved between vacuum boxes 15 by known suitable apparatus, and the box means are then moved toward one another to clamp the pouch in the position shown. As best seen in FIGS. 2, 6 and 7, pouch 11 is engaged by the facing 24 to form a fluid and frictional seal against the walls of the pouch in the regions of the upper corners of the pouch. The high frictional characteristic of the facing material functions to frictionally retain the pouch material whereby the film substantially conforms to the large surface area of the facing material. A vacuum is applied to a box means 15 from source V through their respective tubes 17 causing the resilient material to expand or flex or otherwise flexibly yield to form an opening defined by lip portions 28 and 29 which remain in frictional engagement with the portions of the pouch material while other portions are drawn into the cavity defined by the underlying vacuum slot. Application of a vacuum has the effect of pulling the pouch material through the slit 25 and into the cavity defined by slot 23. As best seen in FIGS. 6 and 7, as a result of the positioning and relative sizing of the superimposed slit/slot/port arrangement, a tortuous cavity is formed into which a portion of the bag wall is drawn to form a bead 27. This action gives rise to a relatively tight grip on the pouch walls. Such action also creates four vertical creases in the pouch walls extending downwardly toward its bottom.

With the pouch walls thus retained, the vacuum boxes are moved apart as in FIG. 2 and while thus positioned, rectangular shaping mandrel 26 is lowered for insertion into the pouch (FIG. 3) followed by movement to square the lower portion of the pouch. Continued downward movement of mandrel 26, accompanied by release of the vacuum on tubes 17 and box means 15, removes the squared-up pouch from retention by the vacuum slit/slot cavity and inserts it into a suitably disposed rectangular carton 12 for movement to suitable filling apparatus.

In the preferred and best mode of operating the invention, the vacuum box body 19 and cover plate 20 may be formed of any suitable rigid material and preferably will be constructed of metal; the flexible pad 22 will be a closed cell, rubbery material and most preferably will be silicone sponge rubber. The facing 24 will be a high friction surface resilient material and most preferably will be a polyurethane resin, treated to have high friction surface characteristics and available commercially as "ML6-55" from Meridian Laboratories, Middleton, WI.

While the vacuum boxes have been described and illustrated herein as having a pair of mutually spaced vacuum port and slots positioned in alignment and a pair of vacuum slits offset over the slots, it will be understood that the invention contemplates such vacuum boxes with any numerical and spatial arrangement thereof as may accomplish the objectives of this invention, the most important consideration being the provision of at least two pairs of vacuum ports in fluid communication wherein the outer pair of ports is resilient and adapted to frictionally engage a wall portion of a flattened pouch and to flex or otherwise open upon application of a vacuum to draw portions of the pouch wall into an underlying cavity. It is contemplated that the grip exerted on the pouch may be varied by the relative thickness of the resilient facing and rubber pad as well as by the extent of alignment of the respective vacuum ports or both, assuming a constant vacuum. It is also contemplated that more than two vacuum slit/slot port paired combinations may be employed, if desired. Additionally, instead of the vacuum boxes with affixed pad and facing coextensive with the surface of the box cover plate, it is contemplated that suitable boxes may comprise a box body and face plate with resilient pad and facing and their respective slots and slits affixed only in the areas overlying the vacuum ports. Similarly, the boxes may be provided with suitable compartments whereby the various ports, slots and slits may be slidably mounted or inserted in desired positions to accomplish the objectives of the invention. Other modifications are contemplated as may fall within the scope of the appended claims.

We claim:

1. In means for handling a flattened pouch having opposed planar walls joined along side portions thereof to define an opening for receiving material to be packed, the combination comprising:

a pair of opposed vacuum box means mounted for movement toward and away from one another;

improved means disposed on each said vacuum box means for opening said flattened pouch, said improved means comprising a series of superimposed, paired, mutually spaced vacuum ports in fluid communication with one another, the outer pair of said vacuum ports being adapted to frictionally engage a wall portion of said flattened pouch and being in flexibly closed position prior to introduction of a vacuum of said vacuum box means;

means for moving said vacuum box means toward one another into position engaging the walls of the flattened pouch in the region of its opening;

means for introducing a vacuum through said vacuum ports upon engagement of said pouch walls by said vacuum box means to effect flexing and opening of said outer vacuum port, and to draw portions of said pouch walls through said port and into a cavity defined by the underlying vacuum ports thereby initiating formation of creases in said pouch walls; and means for moving said vacuum box means apart to urge said pouch walls apart to define said pouch opening.

2. In means for handling a flattened pouch having opposed planar walls joined along side portions thereof to define an opening for receiving material to be packed, the combination comprising:

a pair of opposed vacuum box means mounted for movement toward and away from one another;

improved means disposed on each said vacuum box means for retaining engaged wall portions of said flattened pouch comprising: (a) a vacuum box chamber formed by a hollow box body and a body cover plate, said cover plate having a pair of mutually spaced vacuum ports; (b) a resilient pad affixed to the cover plate and having a pair of mutually spaced, elongated vertical vacuum port slots in superimposed relation to said cover plate ports; and (c) a resilient facing material affixed to the pad and having a pair of mutually spaced elongated vertical vacuum port slits, said slits being in flexibly closed position prior to introduction of a vacuum to said vacuum box means and being offset laterally and in superimposed relation to said vacuum port slots; each of said vacuum ports being in fluid communication with one another;

means for moving said vacuum box means toward one another into position engaging the walls of the flattened pouch in the region of its opening;

means for introducing a vacuum through said vacuum ports upon engagement of said pouch walls by said vacuum box means to effect opening of said vacuum port slits and to urge portions of said pouch walls through said vacuum port slits and into said vacuum port slots to initiate formation of a crease in said pouch walls;

means for moving said vacuum box means apart to urge said pouch walls apart to define said pouch opening.

3. The combination of claim 2 in which said resilient pad is formed to sponger rubber.

4. The combination of claim 3 in which said facing material is formed of polyurethane resin having a high friction surface.

5. The combination of claim 4 wherein said pouch walls are frictionally retained on the surface of said facing material.

6. The combination of claim 4 wherein said each of said superimposed vacuum port slots and slits are so positioned as to form a tortuous cavity in which said pouch wall portion is retained while said vacuum is introduced.

7. The combination of claim 2 including a forming mandrel mounted for movement into said opened pouch upon moving the vacuum box means apart.

8. In means for handling a flattened pouch having opposed planar walls joined along side portions thereof to define an opening for receiving material to be packed, the combination comprising:

a pair of opposed vacuum box means mounted for movement toward and away from one another;

improved means disposed on each said vacuum box means for retaining and opening said flattened pouch comprising: (a) a metal vacuum box chamber formed by a hollow box body and a cover plate therefor having a pair of mutually spaced vacuum ports; (b) a resilient sponge rubber pad affixed to the cover plate and having a pair of mutually spaced, elongated vertical vacuum port slots in superimposed relation to the vacuum ports in said cover plate; and (c) a resilient, polyurethane facing material affixed to said rubber pad and having a high friction surface with a pair of mutually spaced elongated vertical vacuum slits, said slits being in flexibly closed position prior to introduction of a vacuum to said vacuum box means and being offset laterally in superimposed relation to said vacuum port slots; each of said vacuum ports being in fluid flow communication with each other port on said vacuum box means;

means for moving said vacuum box means toward one another into position engaging the walls of the flattened pouch in the region of its opening;

means for introducing a vacuum through said vacuum ports upon engagement of said pouch walls by said vacuum box means to effect opening of said vacuum port slits and to urge portions of said pouch wall through said slits and into said slots to initiate formation of a crease in said pouch walls, and maintaining said vacuum as the said vacuum box means are moved apart; and a forming mandrel mounted for movement into said opened pouch upon moving the vacuum box means apart.

9. In apparatus for opening a flattened pouch of the type including opposed planar walls joined along side portions thereof to define a closed end and an opened end for receiving material to be packed, the combination comprising:

means defining a first and second pair of vacuum boxes mounted for movements toward and away from one another respectively to engage opposed side walls of a closed pouch, and to open the same while so engaged, each of said vacuum boxes comprising a series of superimposed, paired, mutually spaced vacuum ports in fluid communication with one another, the outer pair of said vacuum ports being adapted to frictionally engage a wall portion of said flattened pouch, said outer pair of vacuum ports being in flexibly closed position prior to introduction of a vacuum thereto and opening upon introduction of a vacuum to draw portions of said pouch walls through said openings and into cavities defined by underlying vacuum ports to form a crease in engaged pouch walls as said pairs of vacuum boxes are moved apart.

10. In apparatus for opening a flattened pouch of the type including opposed planar walls joined along side portions thereof to define a closed end and an opened end for receiving material to be packed, the combination comprising:

means defining a first and second pair of vacuum boxes mounted for movement toward and away from one another respectively to engage opposed side walls of a closed pouch, and to open the same while so engaged, each of said vacuum boxes comprising a series of superimposed, paired, mutually spaced vacuum ports in fluid communication with one another, said series of vacuum ports being formed in a rigid vacuum box body cover plate superimposed with a flexible rubber pad in which the vacuum ports are elongated vertical slots which in turn is superimposed with a resilient facing material in which the vacuum ports are elongated vertical slits; the outer pair of said vacuum ports being adapted to frictionally engage a wall portion of said flattened pouch, said outer pair of vacuum ports being in flexibly closed position prior to introduction of a vacuum thereto and opening upon introduction of a vacuum to draw portions of said pouch walls through said openings and into cavities defined by the underlying vacuum ports to form a crease in engaged pouch walls as said vacuum boxes are moved apart.

* * * * *